US005793270A

United States Patent [19]

Beck et al.

[11] Patent Number: 5,793,270

[45] Date of Patent: Aug. 11, 1998

[54] CIRCUIT BREAKER WITH LATCH PREVENTING REBOUND OF BLOW OPEN CONTACT ARM

[75] Inventors: Henry Richard Beck, Moon Township; Kenneth Martin Fischer, Union Township; Richard Edwin White, Brighton Township, all of Pa.

[73] Assignee: Eaton Corporation, Cleveland, Ohio

[21] Appl. No.: 806,030

[22] Filed: Sep. 3, 1996

[51] Int. Cl.[6] ..... H01H 71/12; H01H 77/10

[52] U.S. Cl. ..... 335/16; 218/32; 218/154; 335/46; 335/147

[58] Field of Search ..... 218/22–42, 153, 218/154; 335/16, 46, 147, 195, 201

[56] References Cited

U.S. PATENT DOCUMENTS

| | | | |
|---|---|---|---|
| 4,144,513 | 3/1979 | Shaffer et al. | 335/16 X |
| 4,409,573 | 10/1983 | Di Marco et al. | 335/16 |
| 5,023,583 | 6/1991 | Bratkowski et al. | 335/195 |
| 5,341,191 | 8/1994 | Crookston et al. | 335/16 |

FOREIGN PATENT DOCUMENTS

| | | | |
|---|---|---|---|
| 0209058 | 6/1986 | European Pat. Off. | H01H 77/10 |
| 0266762 | 5/1987 | European Pat. Off. | H01H 77/10 |
| 0255053 | 3/1988 | European Pat. Off. | H01H 7/10 |

*Primary Examiner*—J. R. Scott
*Attorney, Agent, or Firm*—Martin J. Moran

[57] ABSTRACT

The movable contact arms of a circuit breaker are latched in the blow open position to prevent rebound and possible restrike of the arc in response to the very high magnetic repulsion forces generated by a short circuit in the protected electrical system. Each movable contact arm is mounted on a secondary carrier coupled to a main carrier by a spring loaded cam mechanism which allows the movable contact arm to blow open before the main carrier is rotated to the open position by the spring driven circuit breaker operating mechanism. In one embodiment of the invention, the movable contact arm is latched in the blow open position by a latching detent in the cam surface of the cam mechanism. In a preferred embodiment, the secondary carrier is latched by a detent formed by a leaf spring cantilevered from a fixed support. Subsequent rotation of the main carrier by the operating mechanism releases the latch by rotating the secondary carrier clear of the detent formed by the leaf spring.

8 Claims, 9 Drawing Sheets

CIRCUIT BREAKER WITH LATCH PREVENTING REBOUND OF BLOW OPEN CONTACT ARM

BACKGROUND OF THE INVENTION

1. Field of the Invention

This invention relates to circuit breakers having contact arms which are rapidly blown open in response to a short circuit before the spring driven operating mechanism can respond to the fault. More particularly, it relates to a latch arrangement which prevents the blown open contact arm from rebounding and possibly restriking an arc.

2. Background Information

Circuit breakers have sets of separable contacts which include a fixed contact and a movable contact mounted on a movable contact arm. The movable contact arm is rotated by an operating mechanism between a closed position in which the movable contact engages the fixed contact, and an open position in which the contacts are separated to interrupt current flow. Typically, the operating mechanism is spring powered to rapidly open the contacts in response to an overload condition.

The response of the typical spring driven operating mechanism is relatively slow. It is known to provide such circuit breakers with a blow open feature which utilizes the strong magnetic fields generated by very large overcurrent conditions such as accompany a short circuit to quickly open the contacts faster than the response time of the operating mechanism. Typically, in such circuit breakers with a blow open feature, the fixed conductor to which the fixed contact is secured, is positioned adjacent the movable contact arm with the contact closed to carry current in a direction opposite to the current through the movable contact arm. This generates magnetic repulsion forces tending to separate the contacts. Under normal current conditions and moderate overcurrent conditions, the contacts are held in a closed position by contact springs. However, the repulsion forces generated by a short circuit current are so high that they overcome the contact spring forces and rapidly blow the contacts open.

An example of a circuit breaker incorporating a blow open feature is found in U.S. Pat. No. 5,341,191. In this circuit breaker, the movable contact arm is mounted by a two-part pivot assembly. The pivot assembly includes a main carrier which is pivotally rotated by the operating mechanism to open and close the contacts. The movable contact arm is mounted on a second carrier which is pivotally mounted on the first carrier. Normally, the operating mechanism rotates the main carrier which carries with it the secondary carrier and the main contact arm to open and close the separable contacts. In response to a short circuit current, the secondary carrier is rotated relative to the main carrier in response to the very high magnetic repulsion forces generated by the fault current. The current required for the contact arm to blow open is determined by a spring loaded cam assembly which includes cam surfaces on the secondary carrier and spring biased cam followers mounted on the main carrier.

While the blow open circuit breaker of U.S. Pat. No. 5,341,191 has been effective in responding rapidly to short circuit currents, there is room for improvement. The very large repulsion forces accompanying a short circuit generate a great deal of kinetic energy in the movable contact arm which, when it encounters stops at the blow open position rebounds toward the fixed contact. This can result in restriking of an arc between the contacts necessitating a second extinguishing of an arc which imposes heavy wear on the contacts. One solution has been to absorb the kinetic energy of the movable contact arm by mounting dead rubber stops in the cover which the arm strikes, but often the energy cannot be absorbed in this manner.

There is a need therefore, for an improved circuit breaker with a blow open capability.

There is a need for such an improved circuit breaker which prevents the movable contact arm from rebounding and potentially restriking an arc between the fixed and movable contacts. There is a further need for such an improved circuit breaker which latches the contact arm in a blow open position to prevent rebounding.

There is yet another need for such an improved circuit breaker which preferably has an arrangement for easily unlatching the latch device.

SUMMARY OF THE INVENTION

These needs and others are satisfied by the invention which is directed to a circuit breaker having latch means which latches the movable contact arm in the blow open position to prevent rebounding. In a preferred embodiment of the invention, the latch means comprises a cantilevered leaf spring forming a detent which is engaged by means pivotally supporting the movable contact arm as the contacts are blown open. The means pivotally supporting the contact arm comprises first means pivoting the contact arm in response to the repulsion forces blowing the contacts open and which engages the latch means to latch the movable contact arm in the blow open position. The means pivotally supporting the movable contact arm also comprises second means rotated by the operating mechanism in response to a predetermined overload current following blowing open of the separable contacts. This first support means disengages the first means from the latch means. Preferably, the second means rotated by the operating mechanism is the main carrier and the second means is a secondary carrier pivotally mounted on the main carrier.

In accordance with another embodiment of the invention, there is a cam and cam follower arrangement between the main carrier and the secondary carrier. The latch means is a notch in the cam which is engaged by a spring biased cam follower to latch the movable contact arm in the blow open position. In this embodiment, the operating mechanism must overcome the spring bias of the cam follower to disengage the latch as the operating mechanism responds to the short circuit current.

Preferably, the leaf spring is mounted adjacent the carriers so that the secondary carrier engages the leaf spring to latch the movable contact arm in the blow open position. The pivot for the main carrier is positioned so that as the operating mechanism responds to the overcurrent and rotates the main carrier, the secondary carrier which is mounted on the main carrier is separated from the leaf spring thereby unlatching the secondary carrier.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
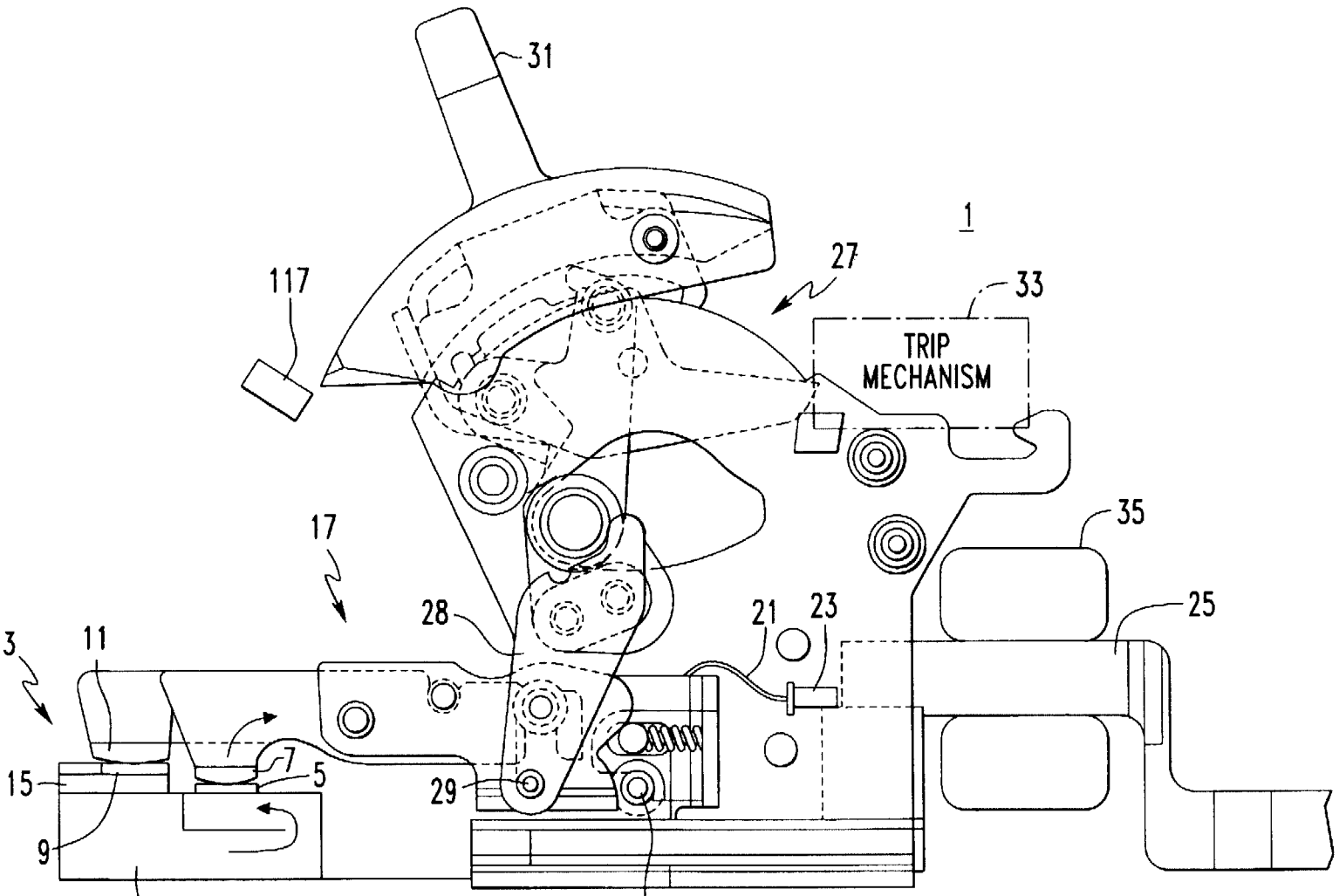
FIG. 1 is a side elevation view of the pertinent parts of a circuit breaker incorporating the invention shown in the on or closed position.

The invention will be described as applied to a molded case circuit breaker of the type described in U.S. Pat. No. 5,241,191, which is hereby incorporated by reference. Such circuit breakers are typically three-phase; however, for simplicity, only the center pole is described in detail and illustrated. Furthermore, only the pertinent parts of the circuit breaker will be illustrated and described in detail to more clearly delineate the invention.

Referring to FIGS. 1–4, the circuit breaker 1 includes for each pole a set of separable contacts 3 which includes a fixed main contact 5 and a movable contact 7. In addition, a fixed arcing contact 9 and movable arcing contact 11 can be provided. The fixed main contact 5 is secured to a line conductor 13, which terminates in a line side terminal (not shown). The fixed arcing contact 9 is mounted on a metal conductor 15 on top of the line conductor 13 so that the fixed arcing contact 9 is above the fixed main contact 5. The movable main contact 7 and movable arcing contact 11 are carried by a movable contact support assembly 17. The movable contact support assembly 17 is pivotally mounted for rotation by pivot pins 19. Flexible braided wire shunts 21 electrically connect the movable contact support assembly 17 to a shunt pad 23 connected to a load side conductor 25 which terminates in a load terminal (not shown). Thus, with the circuit breaker in the on position shown in FIG. 1, in which the separable contacts 3 are closed, electrical continuity is provided from the line terminal (not shown) through the line conductor 13 the separable contacts 3, the movable contact arm assembly 17, the flexible braided wire shunts 21, the shunt pad 23, and the load side conductor 25 to the load terminal (not shown).

Figure 2:
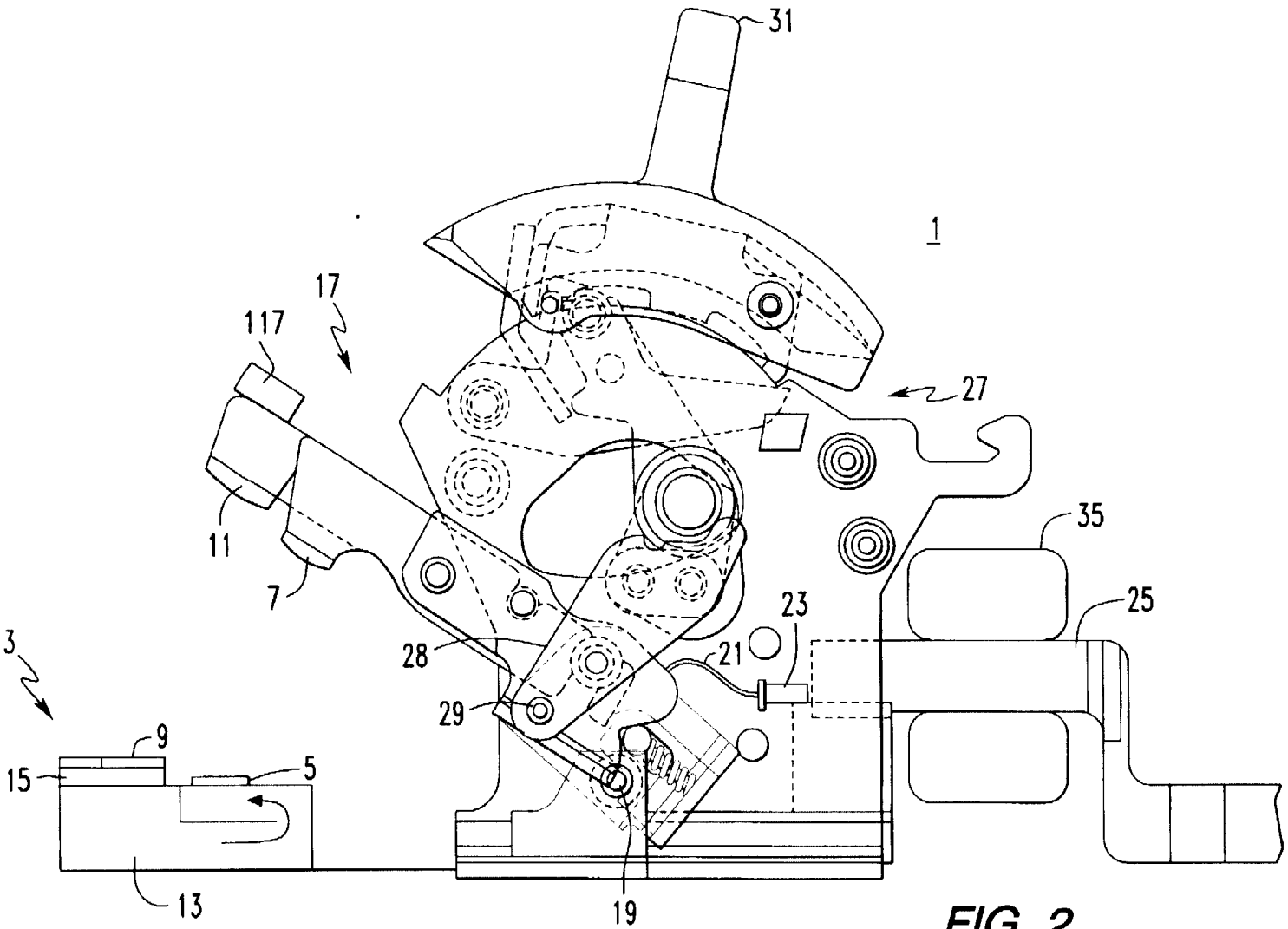
FIG. 2 is a view similar to FIG. 1 showing the circuit breaker in the off or open position.
Figure 3:
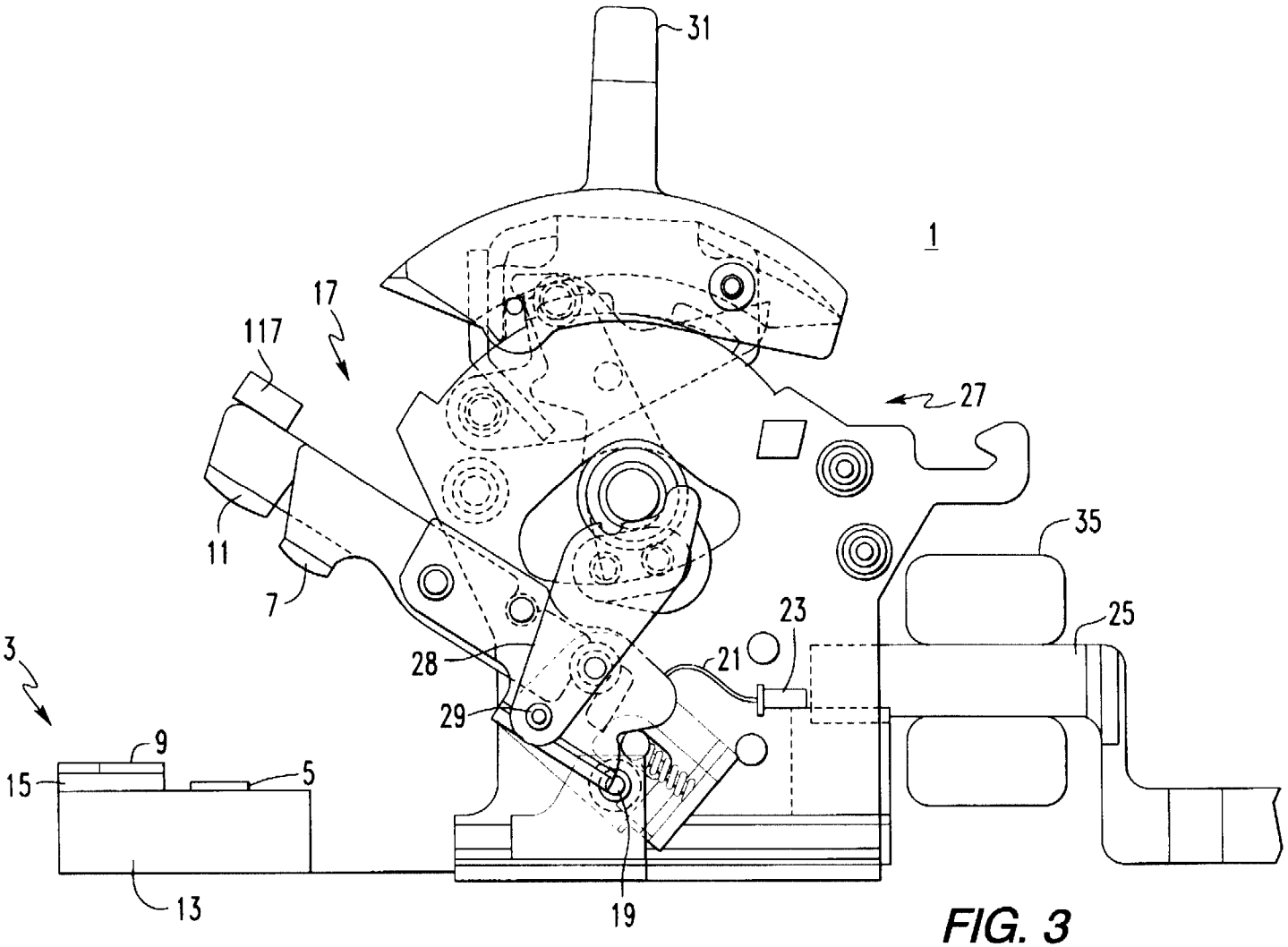
FIG. 3 is a view similar to FIG. 1 showing the circuit breaker in the trip position.

The movable contact support assembly 17 can be rotated by a spring driven operating mechanism 27 which is described in detail in U.S. Pat. No. 5,341,191, and is of a type well known in the art. The operating mechanism 27 includes a lower toggle link 28 which is pivotally connected to the movable contact support assembly 17 by a pivot pins 29. The separable contacts 3 can be opened and closed manually by a handle 31 which forms part of a spring driven operating mechanism 27. Rotation of the handle 31 from the ON position shown in FIG. 1 in which the separable contacts are closed counterclockwise to the OFF position shown in FIG. 2 results in opening of the separable contacts through rotation of the movable contact support assembly 17. The spring driven operating mechanism 27 includes a trip mechanism shown schematically at 33 which responds to certain overcurrent conditions to operate the circuit breaker to the trip position shown in FIG. 3. The trip mechanism 33 is preferably an electronic trip which responds to load current measured by a current transformer 35 inductively coupled to the load conductor 25. Alternatively, the trip mechanism 33 can be a well known thermal-magnetic trip device. The tripped position of the circuit breaker 1 is shown in FIG. 3. As can be seen, the separable contacts 3 are open as in the OFF or OPEN position, but the handle 31 is at an intermediate position between the OFF and ON positions. Before the circuit breaker 1 can again be turned ON, the handle 31 must be moved past the OFF position to a RESET position to reset the operating mechanism 27.

Due to inertia in the spring driven operating mechanism 27 and time delays required to sense and initiate a trip, there is a delay before the operating mechanism 27 can open the separate contacts 3 in response to an overcurrent condition. In order to reduce the time required for the circuit breaker to respond to the very high currents associated with a short circuit, the circuit breaker 1 is provided with a blow open feature. As will be seen from FIG. 1, with the circuit breaker 1 in the CLOSED position, the line conductor 13 extends under the contact support assembly 17. As fully described in U.S. Pat. No. 5,341,191, the line conductor 13 supporting the fixed main contact 5 is slotted so that the current at the end of the line conductor flows in a direction opposite to that of current flowing through the movable contact support assembly 17, as shown by the arrows. This produces magnetic repulsion forces tending to blow the separable contacts 3 open. As will be seen, contact springs normally overcome this repulsion force and maintain the contacts closed. However, the large currents associated with a short circuit, which can exceed 100,000 amps, generate very large repulsion forces which blow the contacts open to the position shown in FIG. 4. As will be described in more detail, the movable contact support assembly 17 has pivoted parts which allow the contacts to open before the spring driven operating mechanism 27 has time to respond.

Figure 5:
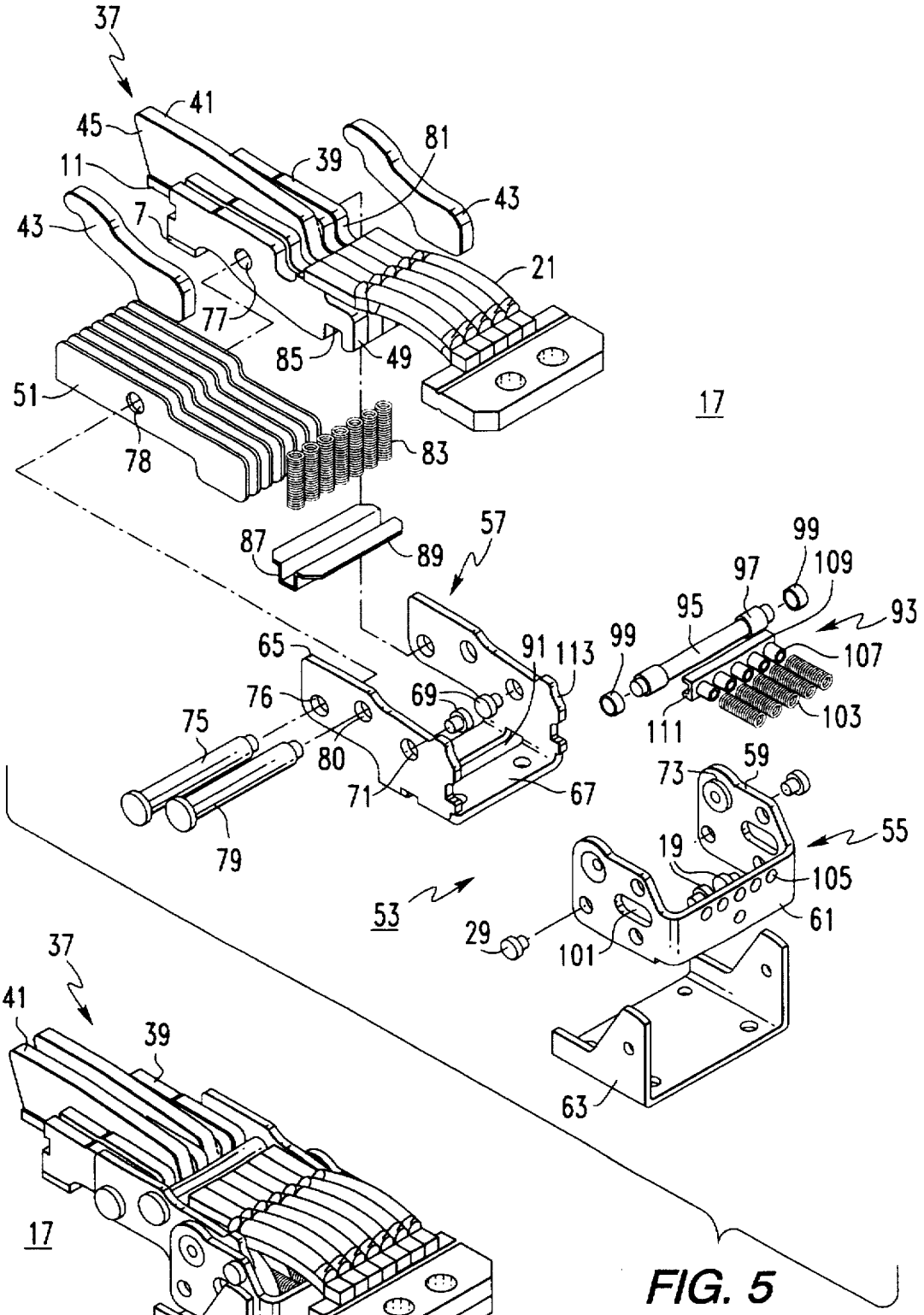
FIG. 5 is an exploded isometric view of the movable contact assembly which forms part of the circuit breaker of FIGS. 1–4.
Figure 6:
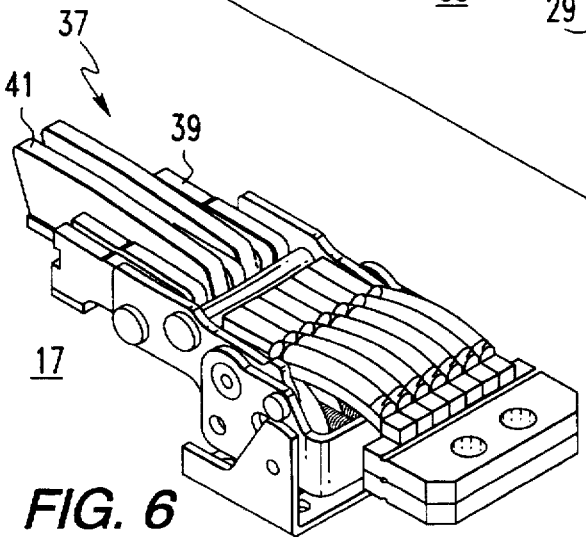
FIG. 6 is an isometric assembled view of the movable contact assembly of FIG. 5.

FIGS. 5 and 6 illustrate the details of the movable contact support assembly 17. This assembly 17 includes a movable contact arm 37 formed by a number of main movable contact arm laminations 39 and longer, arcing movable contact arm laminations 41. The number of each type of lamination depends upon the current rating of a particular circuit breaker. As will be seen in FIG. 5, there are four movable contact arm laminations 39 and one arcing movable contact arm lamination 41. The assembled view of FIG. 6 shows a movable contact arm assembly with a higher current rating having five movable contact arm laminations 39 and two arcing movable contact arm laminations 41. For the lower rated movable contact arms 37, spacer laminations 43 are provided to standardize the remaining parts of the assembly 17. The movable main contacts 7 and movable arcing contact 11 are brazed to a first or free end 45 of the movable contact arm 37 at the main movable contact arm laminations 39 and arcing movable contact arm laminations 41, respectively. The flexible braided wire shunts 21 are brazed to second ends 49 of the contact arm laminations. Fish paper separators 51 are provided between the laminations of the movable contact arm 37 to accommodate for the brazing connections of the braided wire shunts.

The second end 49 of the movable contact arm 37 is pivotally supported for rotation by a pivoted support 53. This pivoted support includes a main carrier 55 and a secondary carrier 57. The main carrier 55 which is U-shaped having legs 59 connected by a bight 61 is pivotally mounted to a fixed bracket 63 by the pivot pins 19.

The secondary carrier 57 has a pair of side pieces 65 joined at one end by a crossmember 67. The secondary carrier 57 is pivotally mounted on the main carrier 55 by pivot pins 69 which extend through apertures 71 in the sides 65 of the the secondary carrier and engage bosses 73 in the legs 59 of the main carrier 55. The movable contact arm 37 is mounted for limited rotation on the secondary carrier 57 by a first pin 75 which extends through holes 76 in the sides 65 and through apertures 77 in the laminations 39 and 41 and the apertures 78 in the fish paper spacers 51. A second pin 79 extends through holes 80 in the sides 65 and is engaged by notches 81 in the top of laminations 39 and 41. The movable contact arm 37 is biased in a counterclockwise direction about the pin 75 and against the pin 79 by a set of helical compression springs 83 which are seated in notches 85 in the contact arm laminations. The other ends of the compression springs 83 are registered by protrusions 87 in a receiver 89 which is seated in a slot 91 and the crossmember 67 of the secondary carrier 57. These springs 83 provide contact pressure, accommodate for contact wear, and rock the movable contact arm 37 during opening so that the main contacts open before the arcing contacts, all as is well known.

In addition to the pivot pins 69, the secondary carrier 57 is coupled to the main carrier 55 by a spring loaded cam connection 93. This cam connection 93 includes a roller pin 95 having shoulders 97 spaced from each end. Rollers 99 on the ends of the pin 95 engage slots 101 extending transversely to the bight 61 of the main carrier 55 in the legs 59. The roller pin 95 is biased away from the bight 61 by a second set of helical compression springs 103 which are seated on projections 105 punched into the bight 61. The other ends of the springs 103 are seated on projections 107 on a spring locator 109 having a semi cylindrical surface 111 which engages the center of the roller pin 95 and is axially retained by the shoulders 97.

With the spring biased roller pin 95 engaged in the slots 101 of the main carrier 55, and the secondary carrier 57 pivotally connected to the main carrier 55 by the pins 69, the shoulders 97 on the roller pin 95 bear against cam surfaces 113 on the ends of sides 65 of the secondary carrier 57.

Figure 4:
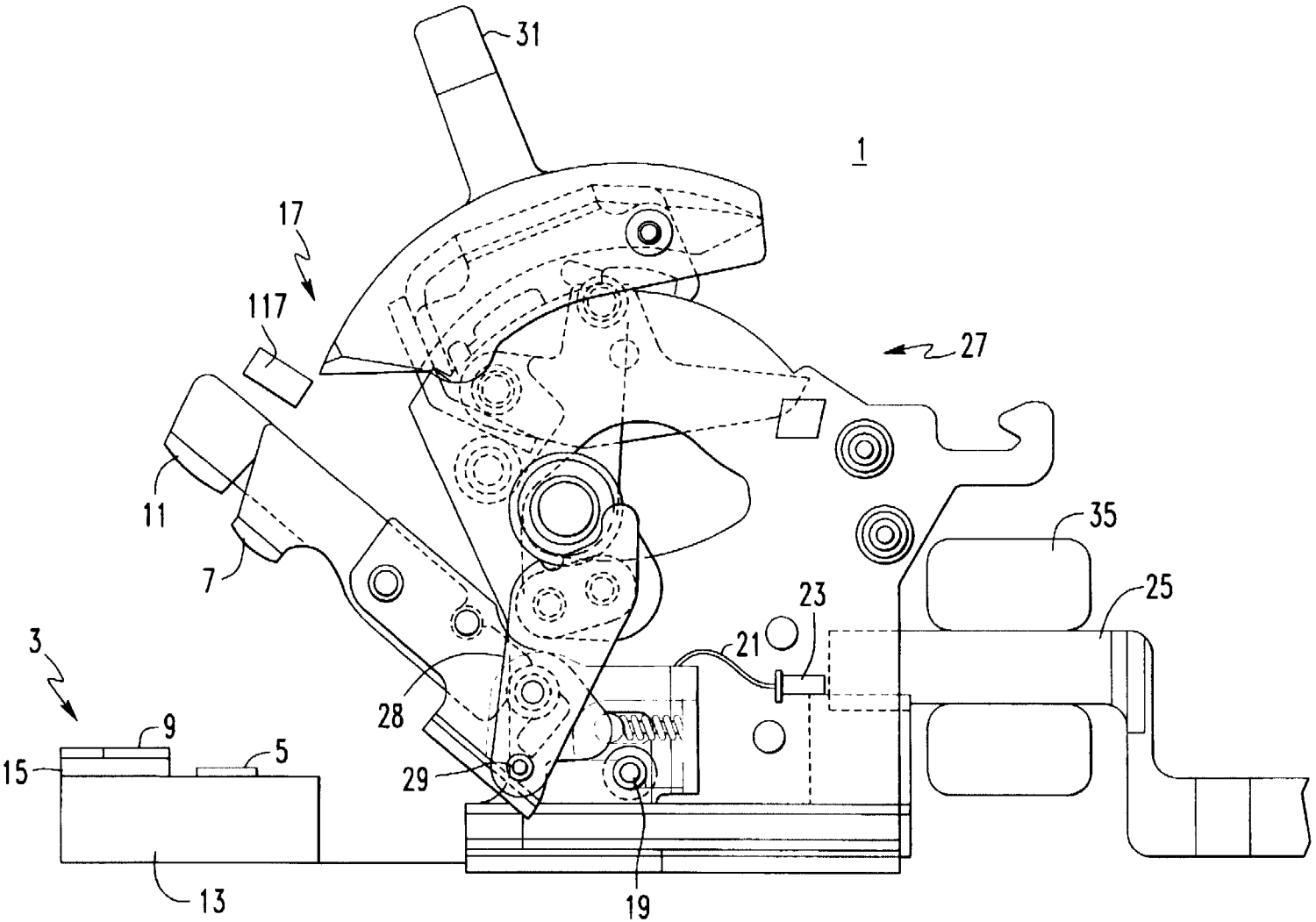
FIG. 4 is a view similar to FIG. 1 showing the circuit breaker with the contacts blown open.
Figure 7A:
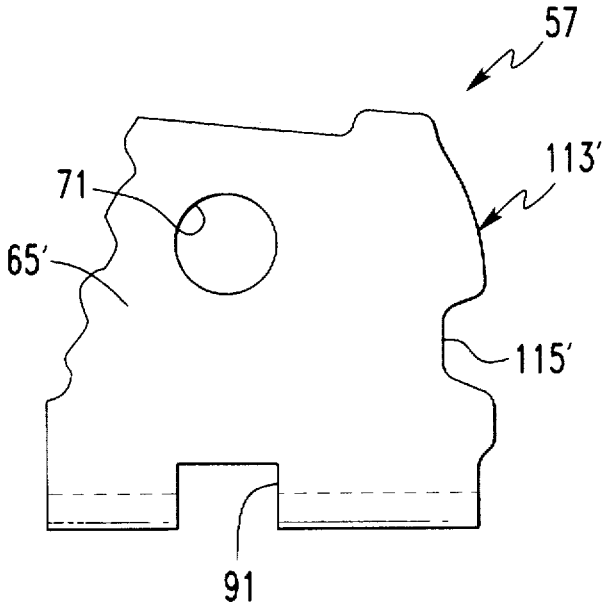
FIG. 7A PRIOR ART
FIG. 7A is a fragmentary side elevation view of the secondary carrier which forms part of the movable contact assembly out of FIGS. 5 and 6, showing the cam profile in accordance with the prior art.

Enlargement of the side 65' of the secondary carrier 57 showing the cam surface 113' of the prior art is shown in FIG. 7A. This cam surface 113' includes a notch 115' which engages the roller pin 95 to couple the secondary carrier 57 to the main carrier 55 for movement therewith. This is the normal condition such as shown in FIGS. 1–3. The very high magnetic repulsion forces generated by a short circuit tend to rotate the movable contact arm 37 clockwise as shown in FIG. 4. When the springs 83 are fully compressed, the torque generated by the repulsion forces is applied to the secondary carrier 57. As the secondary carrier begins to rotate clockwise the inclined upper edge of the notch 115' cams the roller pin to the right as viewed in FIG. 4 compressing the springs 103. As the secondary carrier 57 continues to rotate clockwise the roller pin 95 rolls up on to the main portion to the cam surface 113' allowing the secondary carrier 57 to rotate while the main carrier 55 remains stationary. Clockwise rotation of the movable contact arm 37 in response to the magnetic repulsion forces is terminated when the contact arm hits a stop 117 (shown in FIGS. 1 and 4). When the operating mechanism 27 responds to the short circuit current and begins to rotate the main carrier 55 clockwise, the roller pin 95 rolls back down the camming surface 113' and engages the coupling notch 115'.

Figure 7B:
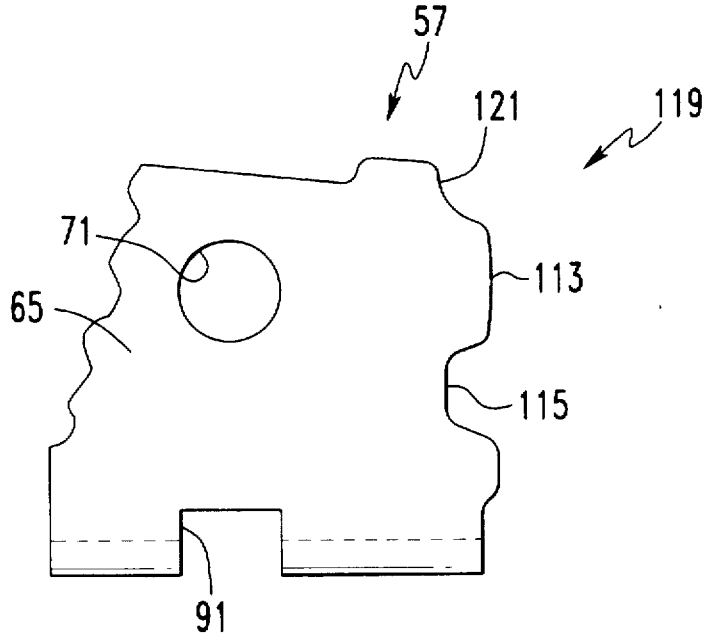
FIG. 7B is similar to FIG. 7A but showing a cam profile in accordance with one embodiment of the invention.

As discussed above, the prior art blow open circuit breaker with the camming arrangement as described in connection with FIG. 7A can be subject to restriking of an arc between a fixed and movable contacts as the contact arm strikes the stop and rebounds toward the fixed contacts. The present invention includes a latching mechanism 119 which latches the movable contact arm 37 in the blow open position to preclude rebound. As shown in FIG. 7B, in accordance with one embodiment of the invention, the latch chain mechanism 119 takes the form of a latching detent 121 at the upper end of the camming surface 113.

Figure 8A:
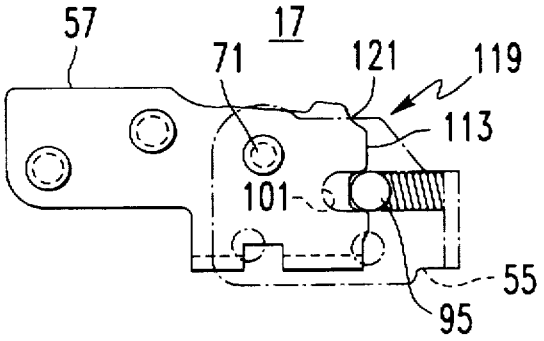
FIG. 8A is a side elevation view of the main and secondary carriers of the movable contact assemblies shown in the off position.
Figure 8B:
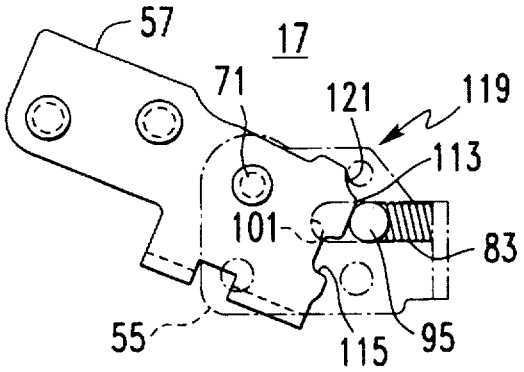
FIG. 8B is a view similar to FIG. 8A shown in an intermediate position as the contacts are blown open.
Figure 8C:
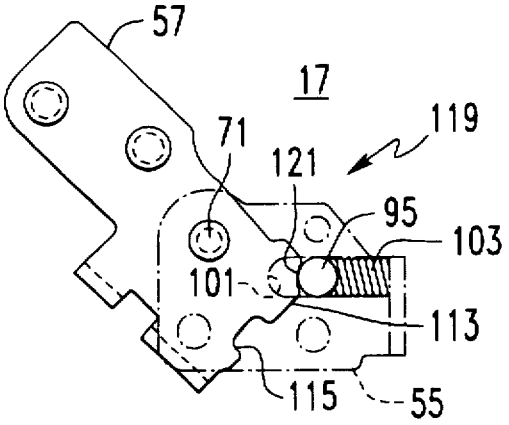
FIG. 8C is similar to FIG. 8A shown with the contacts fully blown open.

FIGS. 8A–8C illustrate the operation of this embodiment of the invention in response to a short circuit current. In these Figures (and in FIGS. 9A–9F which follow), the main carrier 55 is shown in phantom line for clarity. FIG. 8A shows the normal condition in which the roller pin 95 engages the coupling notch 115 in the cam surface 113 to couple the secondary carrier 57 to the main carrier 55 for movement as a unit. In response to a short circuit, the magnetic repulsion forces tend to rotate the secondary carrier 57 clockwise so that the inclined upper end of the slot 115 pushes the roller pin 95 guided in the slots 101 to the right compressing the springs 103. As the repulsion forces build, the pin 95 rolls up onto the main camming surface 113. As can be seen by reference to FIG. 7A and 7B the camming surface 113 is steeper than the prior art camming surface 113'. This tends to decelerate the movable contact arm 37. As the movable contact arm approaches the full blown open position, the roller pin 95 falls into the detent 121 to latch the movable contact arm in the open position. As in the case of the prior art, when the operating mechanism 27 responds to the short circuit current and rotates the main carrier 55 clockwise the roller pin 95 disengages from the detent 121 and rolls back down the camming surface 113 until it falls into the coupling notch 115.

A second embodiment of the invention is shown in FIGS. 9A–9F. In this embodiment, a fixed latching mechanism 119' is utilized. By fixed, it is meant that the latch mechanism 119' is secured to a stationary mounting such as in the example, the fixed bracket 63. In particular, the latch mechanism 119' is a leaf spring 123 having a free leg **123*a* cantilevered from a leg 123*b* fixed to the bracket 63. The leg 123*a* has a bend 125 toward the free end forming a detent 127. A reverse bend 129 forms a terminal portion 131 of the leg 123**.

Figure 9A:
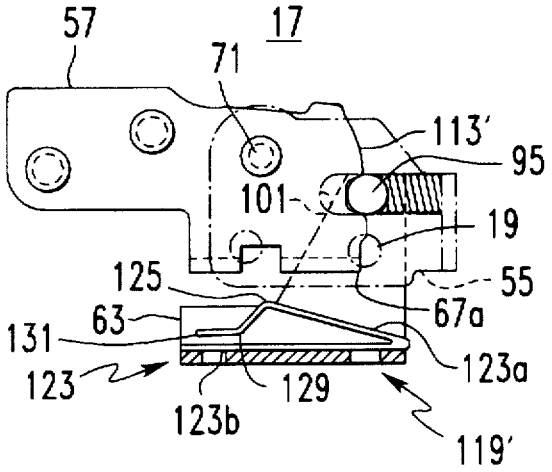
FIG. 9A is a side elevation view of the main and secondary carriers with a latch in accordance with a second embodiment of the invention shown with the contacts closed.
Figure 9B:
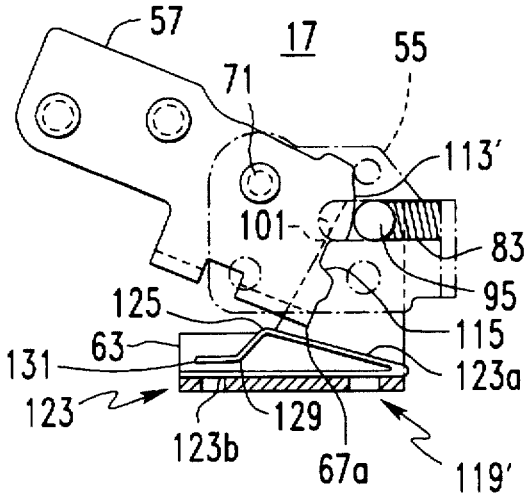
FIG. 9B is the same as FIG. 9A shown with the contacts beginning to blow open.
Figure 9C:
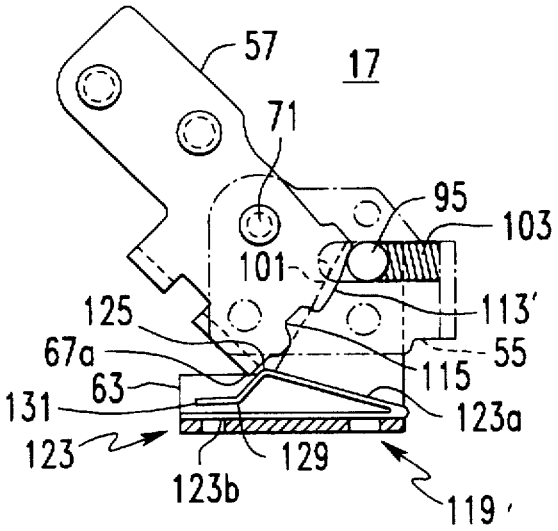
FIG. 9C is similar to FIG. 9A shown with the contacts fully blown open and latched.

As shown in FIG. 9B, as the secondary carrier 57 is decoupled from the main carrier 55 by the magnetic repulsion forces, the edge 67A of the cross member 67 on the secondary carrier rotates toward the leaf spring 123. With continued rotation of the secondary carrier 57, the edge 67A deflects the cantilevered leg 123A until it falls into the detent 127 as the movable contact arm reaches the fully open position. The cantilevered leg 123A then returns to its unflexed position as shown in FIG. 9C to latch the movable contact arm in the blown open position.

Figure 9D:
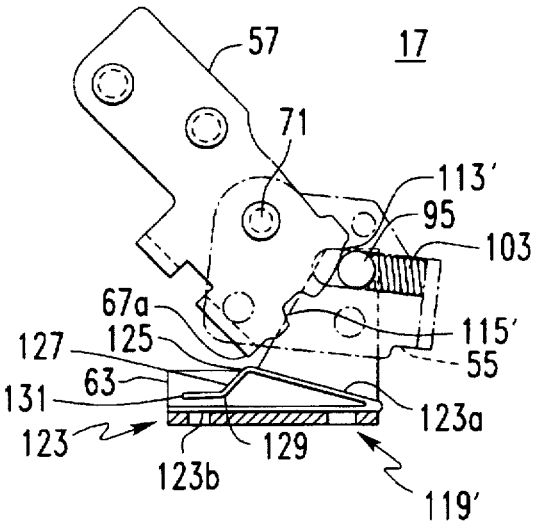
FIG. 9D is similar to FIG. 9A shown at the beginning of the reset function as the main carrier begins to rotate.
Figure 9E:
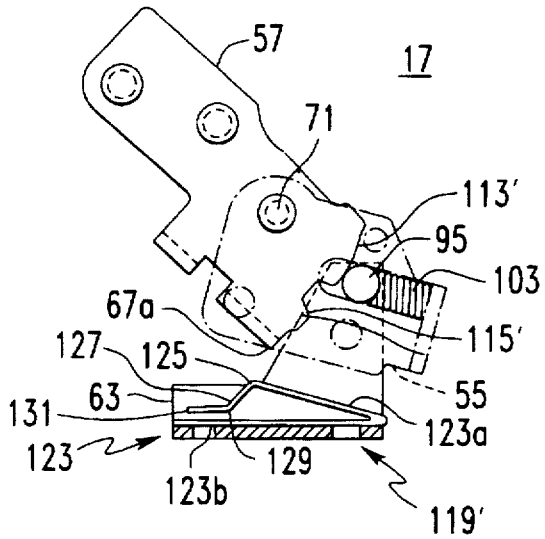
FIG. 9E is similar to FIG. 9A shown at an intermediate reset position.
Figure 9F:
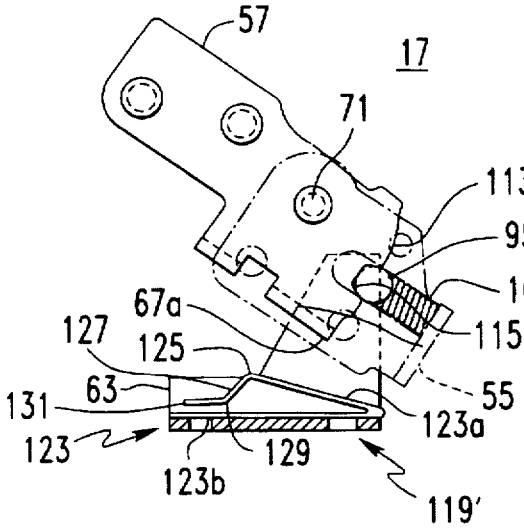
FIG. 9F is similar to FIG. 9A with the carriers fully reset but with the contacts open.

When the operating mechanism responds to the short circuit current and begins to rotate the main carrier 55 about the pivot pins 19, the edge 67A of the cross member 67 on the secondary carrier 57 begins to lift out of the detent 127 as shown in FIG. 9D. As the main carrier 55 continues to rotate with the edge 67A clear of the leaf spring 123 and with a movable contact arm held against the blow open stop (not shown), the roller pin 95 begins to roll down the camming surface 113' as shown in FIG. 9E and falls into the coupling notch 115' as the main carrier 55 continues its clockwise rotation. In this embodiment of the invention, the prior art camming surface 113' can be maintained. All that is required is the addition of the leaf spring 123. This embodiment is preferred not only for this reason, but also because of the smooth release of the latch 119' without the additional force required in the embodiment of FIGS. 8A–8C to release the roller pin from the latching detent 121.

While a preferred form of the leaf spring 123 is shown in FIGS. 9A–9E, the second leg 123*b* of the leaf spring 123 can be eliminated and the leg 123*a* can be cantilevered from one end by securing it to the bracket 63 by other means. In addition, the leaf spring 123 could be terminated at 125 since the secondary carrier 57 is rotated away from the leaf spring by rotation of the main carrier 55.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A circuit breaker comprising:

separable contacts comprising a fixed contact and a movable contact;

a movable contact support assembly including a movable contact arm to which said movable contact is fixed adjacent a first end, and means pivotally supporting said movable contact arm adjacent a second end;

an operating mechanism operatively connected to said movable contact support assembly to rotate said movable contact support assembly between a closed position in which said separable contacts are closed to conduct current and an open position in which said separable contacts are open to interrupt current;

a fixed conductor on which said fixed contact is mounted positioned relative to said movable contact arm when said separable contacts are closed to generate in response to a predetermined overcurrent, magnetic repulsion forces which blow said separable contacts open through rotation of said movable contact arm to a blow open position; and latch means releasably latching said movable contact arm in said blow open position to prevent rebound toward said closed position, said means pivotally supporting said movable contact arm comprising first means pivoting said movable contact arm in response to said repulsion forces blowing said separable contacts open and engaging said latch means to latch said movable contact arm in said blow open position, and second means rotated by said operating mechanism in response to said predetermined overcurrent following blowing open of said separable contacts, disengaging said first means from said latch means.

2. The circuit breaker of claim 1 wherein said latch means includes a latch member and means fixedly mounting said latch member adjacent said first means for engagement thereby as said separable contacts are blown open.

3. The circuit breaker of claim 2 wherein said latch member comprises a cantilevered leaf spring having detent means, said first means pivoting said movable contact arm in response to said repulsion forces deflecting said leaf spring as said movable contact arm is blown open and engaging said detent means to releasably retain said movable contact arm in said blow open position.

4. The circuit breaker of claim 3 wherein said second means rotates said first means away from said leaf spring to disengage said first means from said detent means when said operating mechanism responds to said predetermined overload current.

5. A circuit breaker comprising:

separable contacts comprising a fixed contact and a movable contact;

a movable contact support assembly including a movable contact arm to which said movable contact is fixed adjacent a first end, and means pivotally supporting said movable contact arm adjacent a second end;

an operating mechanism operatively connected to said movable contact support assembly to rotate said movable contact support assembly between a closed position in which said separable contacts are closed to conduct current and an open position in which said separable contacts are open to interrupt current;

a fixed conductor on which said fixed contact is mounted positioned relative to said movable contact arm when said separable contacts are closed to generate in response to a predetermined overcurrent, magnetic repulsion forces which blow said separable contacts open through rotation of said movable contact arm to a blow open position; and latch means releasably latching said movable contact arm in said blow open position to prevent rebound toward said closed position, said means pivotally supporting said movable contact arm comprising a main carrier, main pivot means pivotally mounting said main carrier for rotation about a main pivot axis, a secondary carrier, secondary pivot means pivotally mounting said secondary carrier on said main carrier for rotation about a secondary pivot axis, means securing said second end of said movable contact arm to said secondary carrier for rotation with said secondary carrier, means connecting said operating mechanism to said main carrier for rotating said main carrier and with it said secondary carrier and said movable contact arm between said closed and open positions of said separable contacts, said secondary carrier rotating relative to said main carrier when said movable contact arm is blown open by said magnetic repulsion forces, said latch means engaging said secondary carrier to latch said movable contact arm in said blown open position.

6. The circuit breaker of claim 5 wherein said latch means comprises a cantilevered leaf spring having detent means, said secondary carrier deflecting said leaf spring as said movable contact arm is blown open and engaging said detent means to releasably retain said movable contact arm in said blow open position.

7. The circuit breaker of claim 5 wherein said means pivotally supporting said movable contact arm includes cam means on one of said main carrier and secondary carrier, and cam follower means on the other of said main carrier and secondary carrier biased against said cam means to set said predetermined overcurrent at which said separable contacts blow open, and wherein said latch means comprises a detent in said cam means which is engaged by said biased cam follower to latch said movable contact arm in said blow open position.

8. A circuit breaker comprising:

separable contacts comprising a fixed contact and a movable contact;

a movable contact support assembly including a movable contact arm to which said movable contact is fixed adjacent a first end, and means pivotally supporting said movable contact arm adjacent a second end;

an operating mechanism operatively connected to said movable contact support assembly to rotate said movable contact support assembly between a closed position in which said separable contacts are closed to conduct current and an open position in which said separable contacts are open to interrupt current;

a fixed conductor on which said fixed contact is mounted positioned relative to said movable contact arm when said separable contacts are closed to generate in response to a predetermined overcurrent, magnetic repulsion forces which blow said separable contacts open through rotation of said movable contact arm to a blow open position; and latch means releasably latching said movable contact arm in said blow open position to prevent rebound toward said closed position, said latch means comprises a leaf spring, and means cantilevering said leaf spring from a fixed support adjacent said means pivotally supporting said movable contact arm, said means pivotally supporting said movable contact arm deflecting said leaf spring as said movable contact arm is blown open and engaging detent means in said leaf spring to releasable retain said movable contact arm in said blow open position.

* * * * *